US005833385A

United States Patent [19]

Carnahan et al.

[11] Patent Number: 5,833,385

[45] Date of Patent: Nov. 10, 1998

[54] PLUG-IN LOCK ASSEMBLY

[76] Inventors: Garnett Carnahan; Caroline Carnahan, both of 337 E. Lindbergh St., Nixa, Mo. 67514

[21] Appl. No.: 614,144

[22] Filed: Mar. 12, 1996

[30] Foreign Application Priority Data

Oct. 13, 1995 [CH] Switzerland ..... 95 2 44870.X

[51] Int. Cl.[6] ..... B25G 3/00

[52] U.S. Cl. ..... 403/377; 403/326; 297/451.5; 114/363; 248/158; 248/503.1

[58] Field of Search ..... 297/451.5; 114/363; 248/158, 503.1, 523, 222.11; 403/377, 376, 362, 185, 329, 326, 359

[56] References Cited

U.S. PATENT DOCUMENTS

| | | | |
|---|---|---|---|
| 2,621,906 | 12/1952 | Van Guilder | 403/329 X |
| 3,119,588 | 1/1964 | Keats | 248/158 |
| 3,825,962 | 7/1974 | Grounds et al. | 114/363 |
| 4,078,757 | 3/1978 | Waters | 248/158 X |
| 4,697,949 | 10/1987 | Perez | 403/361 |
| 4,928,620 | 5/1990 | Currey | 114/363 |
| 4,977,848 | 12/1990 | Currey | 114/363 |

OTHER PUBLICATIONS

*The Springfield Marine Company 1996 Marine Products Catalog*, P.O. Box 588, Nixa, Missouri 65714.

Springfield Marine Company "1995 Marine Products" catalog, Jul. 1994 (public availability).

*Primary Examiner*—Kenneth J. Dorner
*Assistant Examiner*—William L. Miller
*Attorney, Agent, or Firm*—Beveridge, Degrandi, Weilacher & Young, LLP

[57] ABSTRACT

A plug-in-lock assembly particularly useful for locking in fixed position a pleasure boat seat with respect to the deck of the boat. The plug-in-lock assembly features a base assembly and stem combination. The base assembly features a base within which is formed a reception cavity and a bushing ring supported by the base and extending into the reception cavity. The bushing ring has an interior surface which contacts with the stem once inserted. The base assembly also includes a center post positioned within the reception cavity and supported by the base. The center post has a top surface and a side wall with the side wall being spaced from an interior surface of the base defining the reception cavity so as to define a stem reception gap between said wall and interior surface. The invention also features a method for assembling the plug-in-lock assembly.

30 Claims, 13 Drawing Sheets

FIG. 3
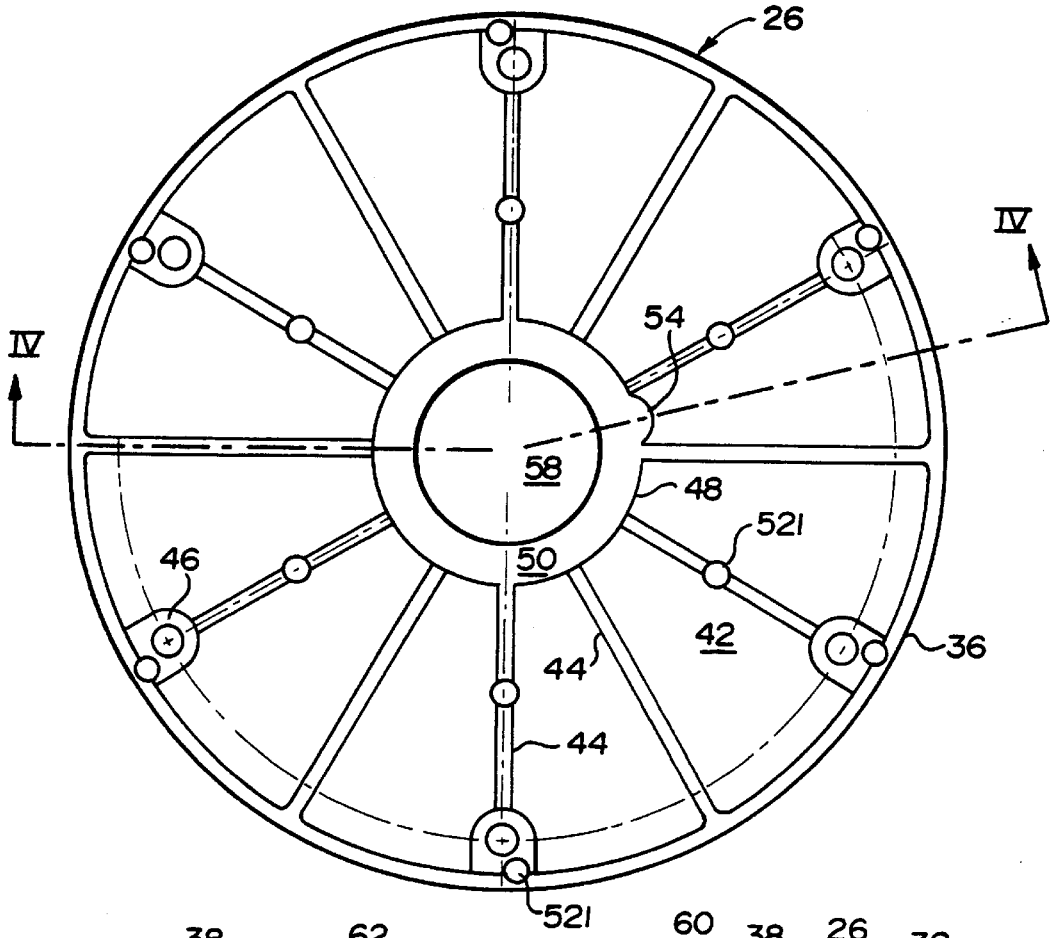
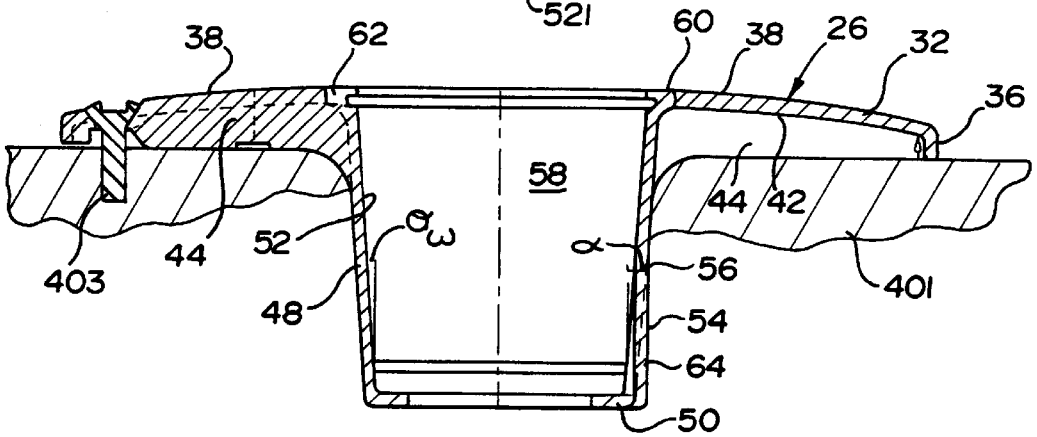
FIG. 4

FIG. 5
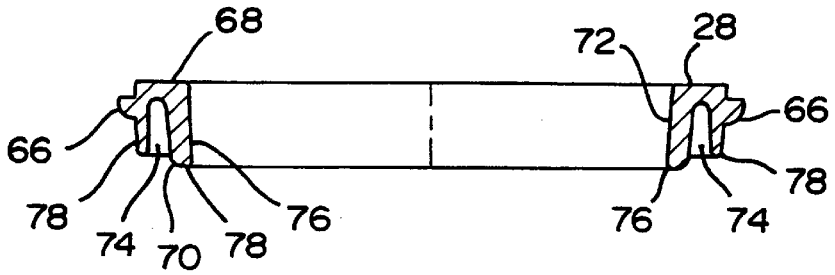
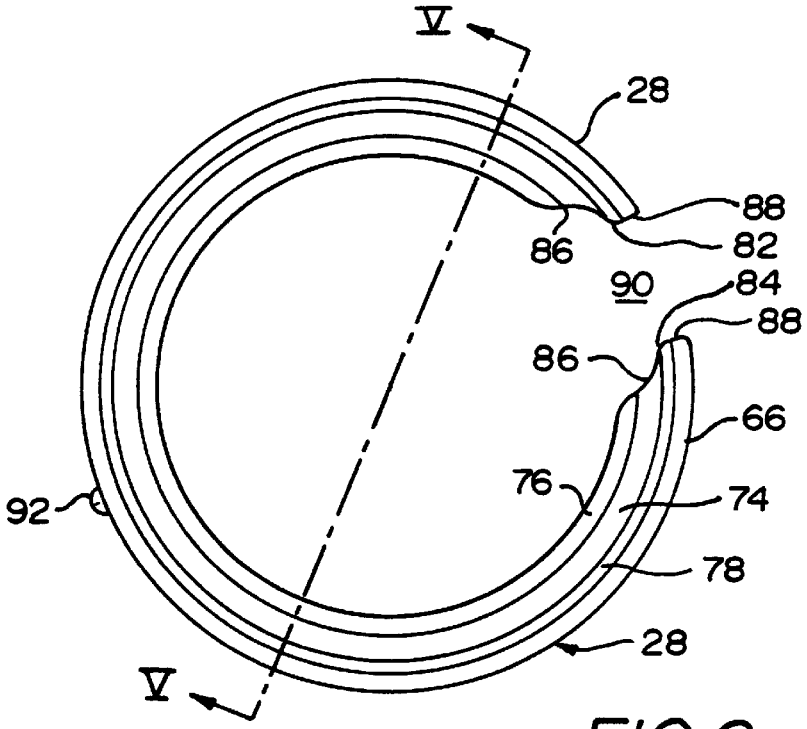
FIG. 6
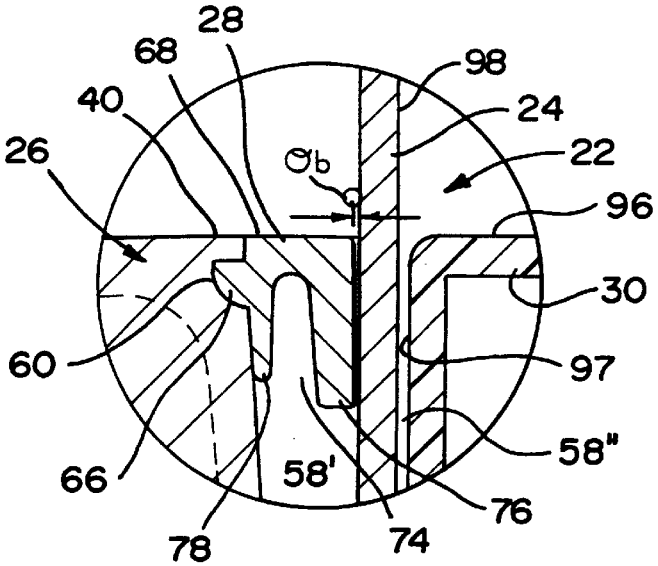
FIG. 7

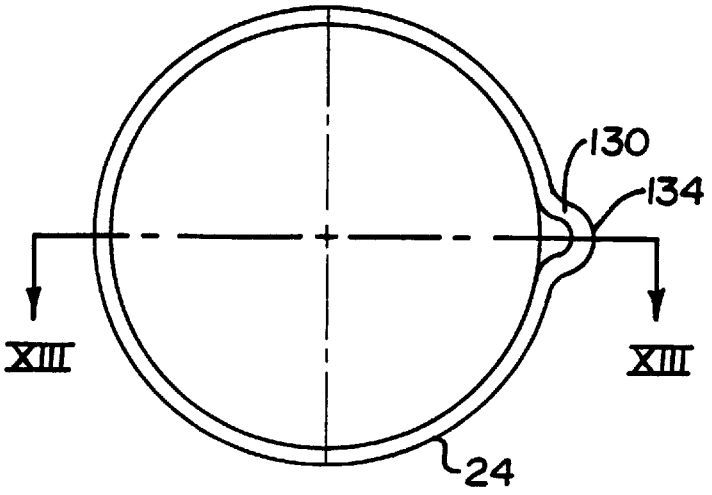
FIG. 12
FIG. 13
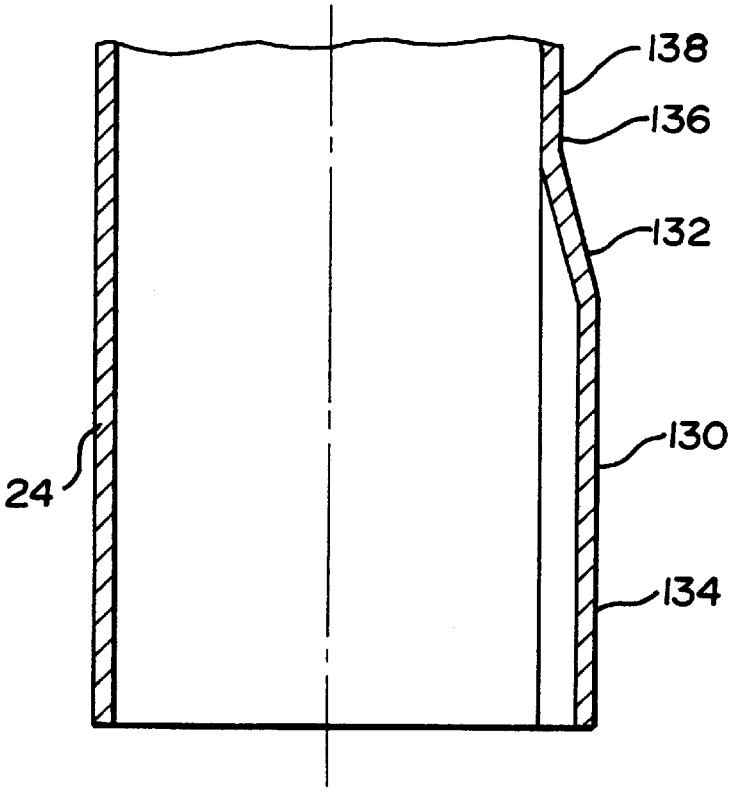

PLUG-IN LOCK ASSEMBLY

FIELD OF THE INVENTION

The present invention is directed at a plug-in-lock assembly which relates to a base assembly and a base assembly and stem combination having particular usefulness in the fixing of boat seats in position.

BACKGROUND OF THE INVENTION

Because of the fast speeds and heavy shaking involved with vehicles such as pleasure boats, seats for these vehicles are typically fixed to the underlying decking by way of welding (making disassembly not possible) or by way of other locking devices which are typically complicated, not easy to disassemble or are expensive to manufacture.

SUMMARY OF THE INVENTION

The present invention is directed at providing a plug-in-lock assembly which relates to a base assembly and a base assembly and stem combination arranged for securely fixing the stem in position while also providing for quick and easy removal of the stem when desired. Thus, the present invention is directed at a plug-in-lock assembly which overcomes the aforementioned problems associated with the prior art such as the inability to disassemble or the ability to disassemble brought about, however, only through a substantial increase in manufacturing cost and complexity.

The present invention provides a plug-in-lock assembly that allows for easy and accurate insertion of a stem into a base and assurance that, once inserted, the stem will remain in position (e.g., will not axially shift, rotate about its central axis or lean with respect to the base).

Moreover, the present invention provides for fast and easy removal of the stem from the base and the base is designed to occupy a minimum of space so as to avoid presenting an obstacle. The base, because of its design, also is low in maintenance requirements (e.g., the avoidance of an oiling requirement). In addition, the present invention fixes the end of the stem in a manner which helps reduce the transference of shock waves from the base to the inserted stem. For example, the design of the invention helps in the reduction of shock waves that normally reach a pleasure boat seat by damping out some of the shock waves that develop in the decking of the boat during travel and are passed to the base securely fixed to the boat's deck. The present invention, in a preferred embodiment, also helps avoid binding due to grit and sand build up by providing means for avoiding a build up of sand.

In achieving the aforementioned advantages, the preferred embodiments of the invention feature a base assembly for supporting a stem that includes a base having a reception cavity formed therein and a bushing ring supported by the base and extending into the reception cavity. The bushing ring is positioned so as to have an interior surface adapted for contact with an inserted stem.

The base assembly also includes a center post positioned within the reception cavity and supported by the base. The center post has a top surface and a side wall with the side wall being spaced from the interior surface of the bushing ring so as to define a stem reception gap therebetween. The stem reception gap, at least at its top, is sized slightly larger than the stem's thickness for easy insertion. However, the gap is made not much larger (radially larger by about 1–5 mm) to avoid having trash or other debris fall into and clog the gap. The stem reception gap preferably narrows in width from its top toward a lower region of the gap (e.g., achieved through an outward tapering of the center post side wall, an inward tapering of the wall defining the reception cavity, the addition of a space reduction element on the exterior of the bottom end of the inserted stem or any combination thereof). The narrower end of the gap is designed to fixedly secure the end of the stem in position. For example, the center post can be formed so as to provide a gap width (with respect to an opposite supporting component such as the reception cavity's side wall or a space reduction component) at its base which is essentially the same as the stem's thickness or no more than 3 mm greater than the stem's thickness. Alternatively, the center post can be formed with a flanged rim with groove to pinchingly receive the inserted end of the stem. The center post also can be formed of a plastic material such as nylon which could deform to some extent upon insertion of the stem into position. With a center post formed of a plastic material or other deformable material, it is possible to have the gap width defined at the center post's base less than the thickness of the stem (e.g., 1–3 mm less) whereupon the center post's exterior wall or some other component adjacent to the center post can deform slightly as the stem is inserted into position. This provides a secure fitting of the stem in the base.

In a preferred embodiment, the bushing ring is received at a first end of the reception cavity and the center post includes a flanged rim which is supported by a bottom section of the base at a second end of the reception cavity. The flanged rim is dimensioned so as to contact a free end of the stem when inserted into the reception cavity while the bushing ring is dimensioned so as to contact and center the inserted stem at a location spaced from the free end of the stem. Also, the flanged rim preferably has a circular groove and an upwardly extending flange section radially outward of the groove. This upwardly extending flange section and groove help firmly hold the end of the stem as the flange section provides the aforementioned gap reduction function and helps pinch the end of the stem between it and the outer wall of the main body of the central post. Also, the groove itself helps center the rim and also provides a pinching function to the end of the stem.

The bushing ring includes an interior protrusion which is inclined toward a central axis of the center post with the protrusion being elastically deformable such that the protrusion deflects radially outward upon insertion of the stem into the reception cavity while biasing the stem into a central position and helping in the damping of shock waves passing from the base to the stem. The bushing ring is secured to the base by way of a ringed flange in one of the bushing ring and base and a corresponding ringed recess in an opposite one of the bushing ring and base. The bushing ring has a second protrusion positioned outward of the inclined protrusion which second protrusion contacts a surface wall of the base defining the reception cavity. In addition, the bushing ring has a ringed slot positioned between the two protrusions so as to facilitate the elastic deflection.

The center post and bushing ring are preferably formed of a plastic material (e.g., the same material) and the base formed of a metal material (e.g., nylon or polyethylene plastic for the center post and bushing ring and aluminum or steel alloy metal for the base). In one embodiment of the invention, one of the center post and base also includes a recess section and an opposite one a protruding section which is received within the recess section so as to axially lock the center post with respect to the base. In this embodiment, the bushing ring is received at a top end of the reception cavity which is opposite a second end of the reception cavity, and the base includes a ringed recess located at a location spaced from the second end of the reception cavity, and the center post includes a flanged rim positioned at the second end of the cavity. The flanged rim of the center post included an upward and outwardly extending flange section which is elastic and has a tip dimensioned for reception in the flanged ringed recess in the base.

The present invention also features an arrangement wherein the base and bushing ring have cooperating means for axially locking the bushing ring with respect to the base and rotationally locking the bushing ring with respect to the base. It is possible to provide a common locking element for both rotation and axial locking, but the below disclosed separate assembly or components for achieving these two functions is preferred.

The base assembly further comprises cooperating means for axially locking the center post with respect to the base and for rotationally locking the center post with respect to the base. Again, such means can include a single component or assembly (e.g., a radially extending ridge which blocks rotation and also has an indented surface which represents the surface with which a spring biased axial lock hook engages) or two separate assemblies or components directed at the two different functions. The base of the present invention also features means for preventing the stem from rotating with respect to the base following insertion of the stem. A suitable rotation prevention means can include, for example, a groove housing formed in the base's extension and a bulbous extension in the stem received thereby. An example of a suitable rotation locking member includes a ridge like member extending off from the interior surface defining the reception cavity of the base's extension which ridge member is dimensioned for receipt within a correspondingly shaped groove formed in the stem to be inserted. A spring lock assembly fixed to the stem and designed to connect with some portion of the base assembly such as a lower surface of the bushing ring can also be utilized for providing an axial lock.

The base preferably has an upper horizontal section surrounding the reception cavity. In addition, the bushing ring also preferably includes a horizontal section and the top of the center post is preferably horizontal such that each of the horizontal sections and the top of the post lie on one common, horizontal plane (or vertical plane if the base is mounted on a vertical support surface). This common plane arrangement helps avoid having a person trip or catch on the base assembly when it is mounted on an underlying surface, such as the deck of a pleasure boat. Also, while the present invention is particularly designed for use as a plug-in-lock assembly for a pleasure boat, the design of the present invention is also well suited for other uses such as the locking of instruments, equipment, or other objects in a table, underlying floor surface, vertical wall surface or the like. As an example, the present invention would also be well suited for affixing in position an outdoor garden table umbrella.

The reception cavity formed in the base is preferably centered, although an off center or multiple reception cavity arrangement in a single base are further possibilities. The base preferably has a mound or partial sphere configuration (e.g., a cross-section of the upper surface of the base, from the central cavity out to the peripheral edge of the base, being convex along any radial line extending out from the center). In a preferred embodiment of the invention, the base includes an upper disk section and an extension extending out away from an undersurface of the disk section to a free end. The reception cavity is defined by the interior wall surface of the extension as well as an interior surface of the thinner disk shaped section. Also, preferably the reception cavity extends from one end of the base to the other with the free end of the extension being partially closed by way of an inwardly extending flange which provides a support for the center post bottom. Also, the disk section preferably has a smoothly finished upper surface with a plurality of equally spaced and serially arranged counter sunk or tapered reception holes for bolts or the like.

The disk section also features a smoothly contoured peripheral edge with a plurality of radially extending ribs extending inwardly of the peripheral edge all the way to the extension and downwardly from the under surface of the upper portion of the disk shaped section. The ribs, preferably, are inclined from a low height at the peripheral edge to a greater height at the ribs' extension juncture. In an alternative embodiment, the ribs extend inwardly from the peripheral edge, as in the above described embodiment, but to a continuous circular ridge concentric with the outer peripheral edge of the disk section rather than all the way to the extension. The ribs, preferably, gradually increase in height from a lower end at the peripheral edge to a higher end at the circular ridge with the ribs having an accelerated increase adjacent the ridge. Larger height, curved webs are provided between the concentric ridge and the adjacent extension portion.

The center post has a hollow interior with an uninterrupted, covered top at the upper end of a continuous side wall, and a plurality of strengthening ribs extending inwardly from the side wall and downwardly from the top surface to the bottom of the center post. The ribs' thickness is greater near the top surface and, at a minimum, near the side wall's bottom.

In one embodiment of the center post, a lip extension extends off from the rim section of the center post, and the bottom support of the base, represented by the inwardly extending flange support member, is received within a groove defined by the lip extension so as to axially lock the center post to the base.

In another embodiment of the invention, the center post is provided with full length windows between the ribs which are bordered by circular rims above and below. These windows help in avoiding sand build up as the sand either falls out or can be easily sprayed with water or the like to help force the sand out.

The bushing ring preferably extends more radially inward into the reception cavity (when undeflected) than the radial outward end of the stem reception groove formed in the rim of the center post.

The present invention also features a combination comprised of the base assembly and a stem which is designed for specific use with the base assembly. In one embodiment of the stem, a bulbous, groove housing extends radially outward from the remainder of the cylindrical stem. The bushing ring is provided with a clearance gap or cavity through which this bulbous extension at the end of the stem slides during insertion. This bulbous extension has a tapered section and then a vertical section and the base's extension features a similarly contoured groove housing into which the stem is received so as to preclude radial rotation of the stem with respect to the fixed stem once installed.

In a second embodiment of the invention, the stem has an inwardly extending groove defined by a longitudinal groove housing and the extension has an inwardly projecting ridge member at its bottom which is supported also by the flanged support member provided at the end of the extension. The groove in the stem is dimensioned so as to snugly receive the ridge member once the stem is completely inserted into the reception cavity so as to preclude radial rotation of the stem with respect to the base. Also, in one possible embodiment, the groove can be formed with a bulbous innermost portion and a thinner, outermost portion and the radially projecting rotation locking member is provided with a similar contour such that, when the stem is slid over and past the rotation locking member, the stem is not only prevented from rotation, but also radially locked in position.

The present invention also features an axial stem locking assembly which preferably is in the form of a spring lock member with a hooked end that is received within the inwardly extending groove housing described above and which is positioned so as to deflect inwardly during insertion and spring out such that the hook engages the lower end of the bushing ring to thereby lock the stem from axial shifting out of the base.

The present invention also features a method for forming a base assembly which comprises forming a base so as to have an upper disk section, an extension extending off from an under surface of the disk section and a reception cavity formed so as to open out at the top surface of the disk section and extend into and through the extension. The reception cavity also is formed so as to define a stem rotation locking section. The method further comprises installing a bushing member so as to have an upper surface coplanar with a section of the upper surface of the disk surrounding the reception cavity and such that the bushing member extends radially inward within the reception cavity. The installing further includes locking a rotation and axial movement locking arrangement (or arrangements) provided between the bushing member and the base. The method also includes installing a center post in the reception cavity such that it is supported on a support of the base and has a top surface coplanar with the upper surface of the disk and an outer wall spaced from an inner wall of the reception cavity. Installing the center post includes the additional step of locking a rotation and axial movement locking arrangement (or arrangements) provided between the center post and the base. Also, the stem and extension are formed such that the stem is prevented from rotation when inserted into the extension.

BRIEF DESCRIPTION OF THE DRAWINGS

The advantageous aspects of the invention will be more fully appreciated from the following description, particularly when considered in conjunction with the attached drawings, wherein:

FIG. 3 illustrates a bottom plan view of the first embodiment;

FIG. 4 illustrates a cross-sectional view taken along cross-sectional line IV—IV in FIG. 3;

FIG. 5 illustrates a cross-sectional view taken along cross-sectional line V—V in FIG. 6 of the bushing shown in position in FIG. 1;

FIG. 6 illustrates a bottom plan view of that bushing;

FIG. 7 shows an expanded view referenced by circle in FIG. 1;

FIG. 12 illustrates a bottom plan view of the stem;

FIG. 13 illustrates a cross-sectional view of the stem taken along cross-section line XIII—XIII in FIG. 12;

DETAILED DESCRIPTION OF THE PREFERRED EMBODIMENTS

Figure 1:
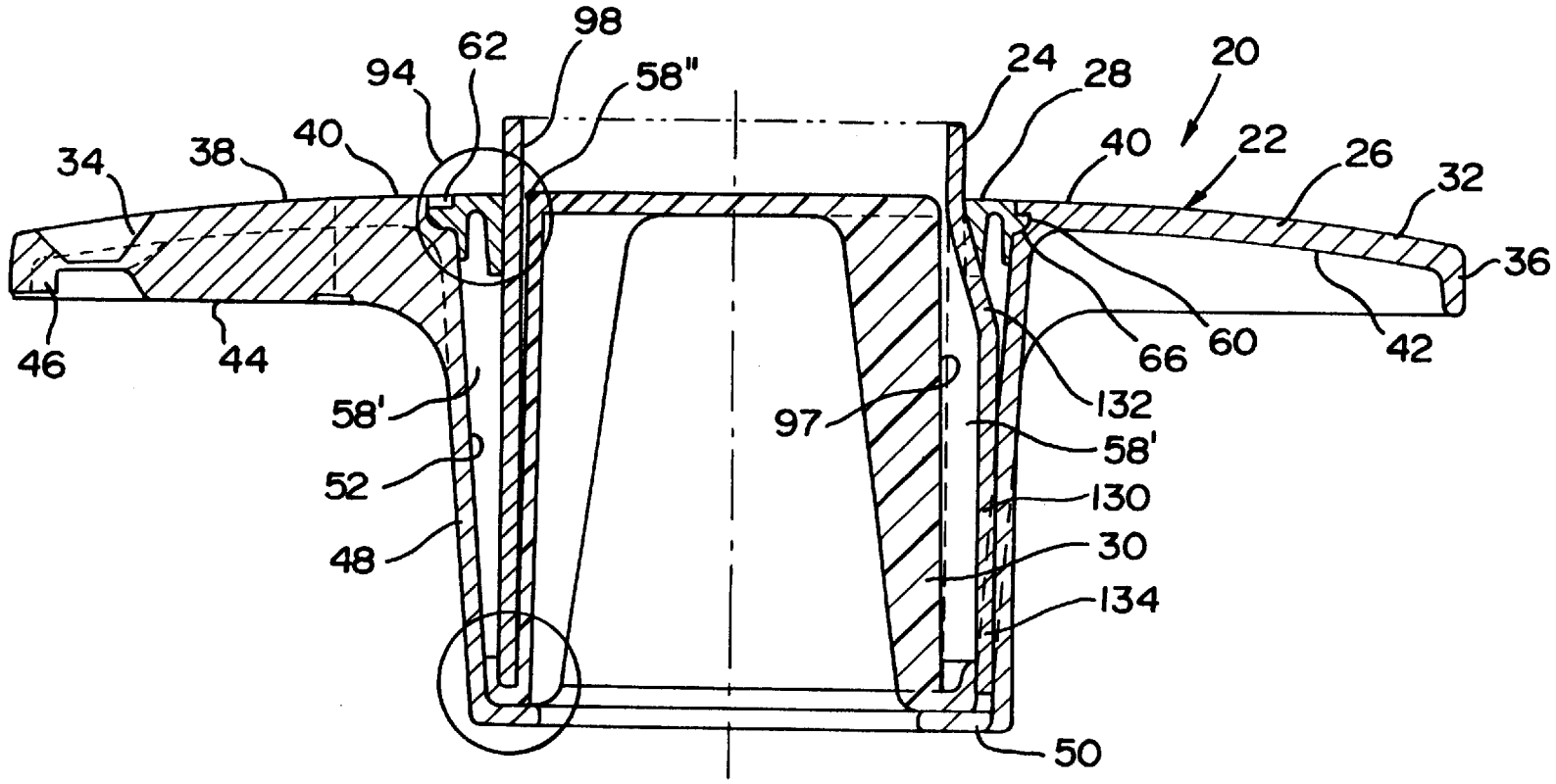
FIG. 1 illustrates a cross-sectional view of a first embodiment of the present invention's base assembly and stem combination.

FIGS. 1–13 illustrate a first embodiment of the present invention's base assembly and stem combination 20 which is comprised of base assembly 22 in combination with stem 24. This embodiment of the present invention is particularly suited for use with fixed chair seats on the deck of pleasure boats and the like wherein stem 24 would form a seat post extending downwardly from a chair seat, while base assembly 22 would be secured to the deck of the boat.

Base assembly 22 is generally comprised of base 26, bushing ring 28 and hat shaped center block 30.

With reference to FIGS. 1–4, base 26 features disk section 32 which preferably has a peripheral edge 36 that is circular shaped and a plurality of bolt holes 34 or the like arranged along a circumference inwardly spaced from the peripheral end 36. As best shown in FIGS. 1 and 4, the upper surface 38 of base 26 is convex in cross-section from outer peripheral end 36 to an area just outward of an essentially horizontal area 40 in upper surface 38.

Base 26 is preferably formed (e.g., cast or molded) of a metallic material such as aluminum or steel with a smoothly, finished upper surface 38. FIG. 3 illustrates the bottom of base 26 and the under surface 42 of disc section 32 off from which extends a plurality of radial, spoke like ribs 44. In a preferred embodiment, at least some of the ribs 44 are modified at their outer end to include boss-sections 46 within which the counter sunk bolt holes 34 open out into so as to provide a through hole. Integrally formed with disk section 32 as well as the inner end of ribs 44 is extension 48 which is cylindrical or formed somewhat frusto-conical in shape such as shown in FIG. 4 wherein θw represents the angle of incline of the interior wall which is preferably 0–5° and most preferably about 1.5°. Extension 48 is provided with inwardly extending flange 50. Flange 50 preferably extends inwardly about 20–30% of the diameter of the interior wall 52 off from which flange 50 extends. In this way, a suitable support surface is provided as explained in greater detail below.

The small circular sections 521 represent preferred locations for placement of ejector pins following the molding or casting process. As best shown in FIGS. 3 and 4, extension 48 also comprises bulbous extension groove housing 54 which originates about half-way along extension 48 as referenced by number 56 in FIG. 4 and gradually slopes outwardly at angle α which is preferably equal to θ (e.g., 1°–5° and most preferably 1.5°). Groove housing 54 extends all the way to flange 50 so as to provide an elongated reception groove.

The depth of reception cavity 58 formed in the disc and extension must be sufficient to provide proper incline prevention support to the stem. A suitable arrangement has the total height of the base about 3 inches with the thickness of the disc and flange support member each being about 0.5 cm. The ribs preferably extend off from the undersurface 42 of the disc section 32 about 1 cm at their shortest end to about 2 cm at their tallest end. The aforementioned concentric ridge extends about 2.5 cm off from the undersurface with the webs going from a 2.5 cm height to a 3.0 or 3.5 cm height.

As shown in FIG. 4, at the upper end of reception cavity 58, below upper surface 38, there is provided circular recess 60 as well as tab cavity 62. At the opposite end of extension 48 adjacent flanged support member 50, there is provided another ringed recess 64 with both recesses 60 and 64 being formed in the interior surface wall 52 of extension 48. FIG. 4 also illustrates the swivel base assembly mounted to attachment structure 401 which can be any suitable underlying support surface such as the deck of a boat. Also, attachment can be achieved through any suitable fastener such as a nut and bolt combination or a threaded fastener such as 403 in FIG. 4.

FIGS. 5 and 6 illustrate the ring shaped bushing member 28 with FIG. 5 showing a cross-sectional view on cross-section line V—V in FIG. 6 and FIG. 6, itself, showing a bottom view of bushing ring 28. As shown in these figures, bushing ring 28 includes circular flange 66 which is preferably essentially intermediately positioned between the upper and lower ends 68, 70 of bushing 28. The surface defined by upper end 68 is illustrated in FIG. 5 to be horizontal while interior surface 72 slopes slightly inward toward the central axis as described in greater detail below. Elongated circular slot 74 opens out at end 70 so as to define internal protrusion 76 and external protrusion 78. Slot 74 and the radial thickness in conjunction with the material of protrusion 78 are preferably designed or chosen such that the protrusion 78 is somewhat elastic so that it can be deflected outwardly while providing a return spring force applied inwardly against stem 24, once the stem is inserted. Preferably bushing ring 28 is formed of a plastic material such as polyethylene (HDPE) or nylon (e.g., type 6) or less preferably, but suitable, a hard rubber or soft metal material such as brass (or the like).

FIG. 6 illustrates that bushing ring 28 is preferably a slotted ring with free ends 82 and 84. Each of free ends 82 and 84 preferably includes concave section 86 and straight section 88. Free ends 82 and 84 define slot opening 90 therebetween. Slot opening 90 is shown in FIG. 6 to be larger than that which appears once the bushing is installed with respect to the base. Preferably, the bushing is designed such that ends 88 have 0–¼" spacing once installed with respect to base 6, while the concavities 86 provide a larger opening. Tab 92 is positioned diametrically opposite to the center of slot opening 90 and extends radially out from upper end 68 and radially past the outer periphery of circular flange 66.

Figure 2:
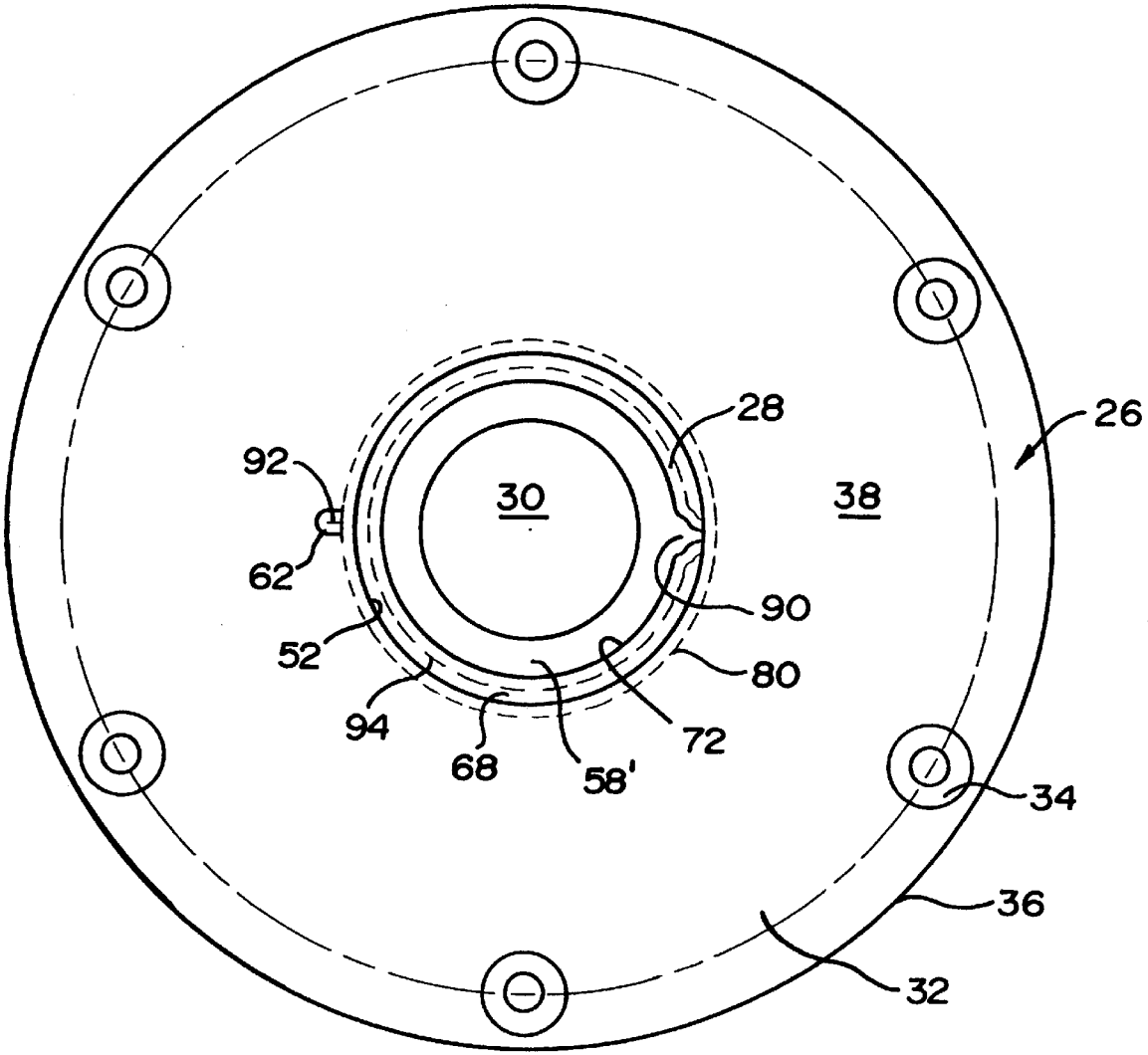
FIG. 2 illustrates a top plan view of the base assembly of the present invention (the combination of FIG. 1 with stem removed).

Interior surface 72 of bushing ring 28 is also represented in FIG. 2 to be radially outwardly spaced from the outer surface of center post 30 so as to define gap 58' which represents an outer portion of cavity 58 earlier referred to in the description of FIG. 4. Tab 92 of bushing ring 28 is received within tab cavity 62 formed in base 26 so as to prevent the rotation of bushing ring 28 with respect to base 26. Alternatively, for locking against rotation, flange 66 can be broken into two or more sections with conforming recesses in the area of the present recess 60 formed in disc section 32. Also, dash line 94 in FIG. 2 illustrates the degree of inward sloping of wall 52 from its upper end to its bottom end where support member 50 is positioned (which upper end is in abutment with the exterior surface of upper surface 68 of bushing ring 28).

FIGS. 1 and 2 illustrate the securement of bushing ring 28 with respect to base 26. As shown in these figures, circular flange 66 of bushing ring 28 (shown by way of outer dash line 80 in FIG. 2) extends into recess 60 formed in disk section 32.

FIG. 7 shows an expanded view of circle 94 in FIG. 1. The above described engagement of bushing ring 28 with base 26 is more clearly illustrated in the expanded view of FIG. 7. Also, FIG. 7 illustrates the relationship between stem 24 and bushing ring 28, specifically the stem's contact with sloped internal protrusion 76. As shown in FIG. 7, the lower end of protrusion 76 is flexed back from its natural inclined orientation. The natural incline is designated by θb and preferably equals 0.5–5% and, more preferably, 1.5%.

Expanded view FIG. 7 also illustrates the relative relationship at the upper end of base assembly 22 which relationship places the upper surface 96 of center block or post 30 on a horizontal and on a common plane with the bushing ring's top surface and the adjacent surface 40 of the disc section 26. The flexing nature of internal protrusion 76 acts to push, elastically, the center line of stem 24 such that it coincides with the center line of center post 30 and, at the same time, provides centering support to the stem. Thus, the internal protrusion 76, with the assistance of the below described lower end engagement of the stem with the base assembly, prevents the stem from tilting beyond an acceptable amount while also providing a cushioning effect which is particularly important in a preferred usage of the invention on a pleasure boat which is subject to high shocks and heavy shaking in traveling over the surface of the water.

Also, the preferred arrangement has the upper surface 96 of center block or post 30, the upper surface 68 of bushing 28 and the section 40 of the upper surface 38 of base 26 lying along a common horizontal plane. This is important from the standpoint of presenting a level surface when the stem is removed such that, for example, a level walking surface is provided when the base assembly is secured to the deck of a pleasure boat. The aforementioned convex upper surface of disk section 32 helps avoid having to position flanged support member 50 too far below the installation surface which can be the decking of a boat, for example. The thickness of disc section 32 is also minimized in relation to the depth requirement of extension 48, so as to avoid too high an extension off from the installation surface. The upper surface can also be completely horizontal rather than convex in cross-section where the depth to which the extension 48 extends below the installation plane or the degree to which the peripheral edge of the disc section 32 extends above the support surface is not of great concern or for other preferred uses of the present invention such as an installation panel for inserting single or multi-stem items such as instruments (e.g., medical instruments) or electronic equipment wherein a horizontal face flush with a table or wall might be preferred.

FIGS. 1 and 7 also illustrate the gap 58" formed between outer surface 97 of center block 30 and the interior wall 98 of stem 24. Gap 58Δ is minimized (3 to 10 mm thick gap) such that upon removal of stem 24 there is lessened the possibility of debris falling into gap 58". Thus, in the situation where the device is used for the fixed seat of a pleasure boat, trash and the like is prevented from falling into the gap 58" and this arrangement has the added advantage of lessening the possibility of the edge of a person's foot dropping into the recess and catching on one surface or the other.

Figure 8:
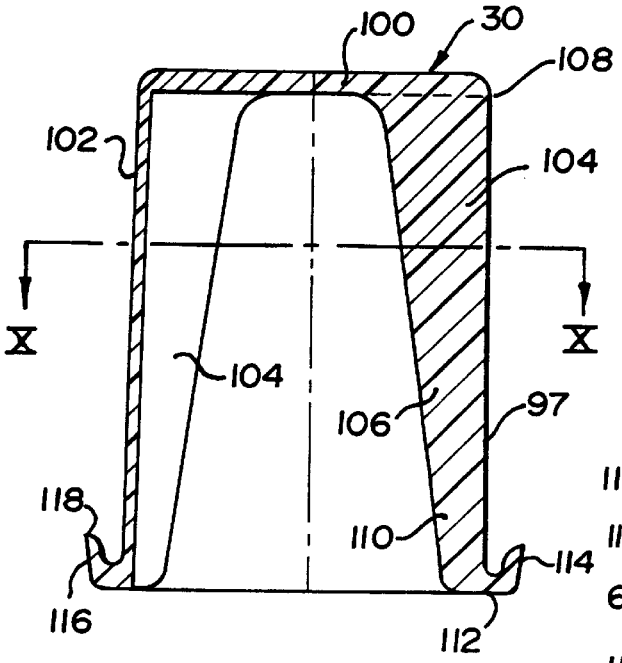
FIG. 8 shows in cross-section (along cross-section line VIII—VIII in FIG. 9) the hat shaped center post shown in FIG. 1.

With reference now to FIGS. 8–11, a more detailed description of center block or post 30 is provided. Center block 30 is preferably formed of a material which is the same or similar to that used for bushing 28 (e.g., nylon or polyethylene plastic) and is integrally molded in the shape shown in FIGS. 8–11. As shown in FIG. 8, block 30 features top surface 100, cylindrical wall 102, and ribs 104 with the latter providing support both from the standpoint of forces being applied down onto top surface 100 when stem 24 is removed and forces that are applied against the block's side wall when the upper end of stem 24 is forced in a direction perpendicular to its center line so as to create a corresponding moment against the side 97 of block 30. Ribs 104 are circumferentially spaced about the cylindrical wall (e.g., 8 equally spaced ribs) and also have an interior surface 106 which slopes outwardly and downwardly from a thicker upper end 108 to a thinner bottom end 110.

Figure 8A:
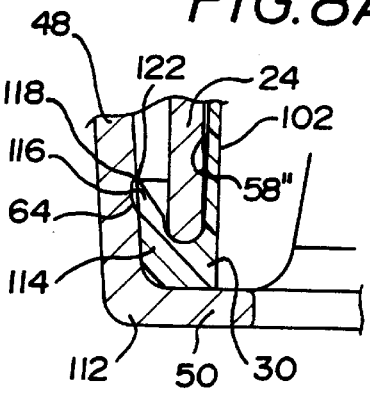
FIG. 8A illustrates the expanded view referenced in FIG. 1 by circle which shows the connection between the bottom of the base, center post and stem.

Block 30 is also preferably hat-shaped and includes lower rim 112 and upwardly and outwardly inclined flange 114 as shown in FIG. 8. Flange 114 features a tapering end 116 which tapers to tip 118 which is in the form of a lip. In addition, rim 112, in combination with the base of flange 114, defines stem reception end recess 120 which is semicircular in cross-section. FIG. 8A illustrates one preferred locking arrangement of block 30 with respect to base 26. As shown in FIG. 8A, ringed recess 64 is preferably provided with a notched upper end 122 which abuts against lip 118 following insertion of block 30 into cavity 58. During this insertion, lip 118 and tapered section 116 are flexed inwardly during the inward sliding of block 30 into cavity 58 until lip 118 is positioned below notched upper end 122 such that lip 118 snaps outwardly into locking engagement with notched upper end 122. Additional securement means can also be relied upon either in place of the above described arrangement or in further support thereof such as the use of a suitable adhesive. Alternatively, a threaded or key/slot engagement or the like might be relied upon which would be useful from the standpoint of future cleaning of any debris which might fall within the cavity despite the small clearance of the gap. However, the illustrated arrangements of the present invention are more preferred since a threaded or key/slot connection would introduce the possibility of block 30 vibrating loose or becoming lost following removal for cleaning or the like.

As shown in FIG. 8A the lower edge of stem 24 is received in nested fashion within the cavity 120 (FIG. 11) provided by block 30. In addition, flanged support member 50 is illustrated in FIG. 8A as providing lower support to rim 112. FIG. 8A also illustrates clearance gap 58" as being much smaller than above. The slot 120 thus prevents any shifting of stem 24 at its lower end once inserted into position in base assembly 22. The present invention also can feature an arrangement wherein block 30 has a slightly tapering outer surface 97 which tapers so as to be at a larger diameter at its bottom base or a slightly stepped arrangement wherein the lower half or so of the block 30 is of a larger diameter than the upper half. These alterations allow for some degree of deformation of block 30 during insertion of stem 24 into position with such deformation providing further stability against an unacceptable degree of incline of stem 24 during use and also providing some degree of cushioning in view of the preferred plastic material involved.

Figure 9:
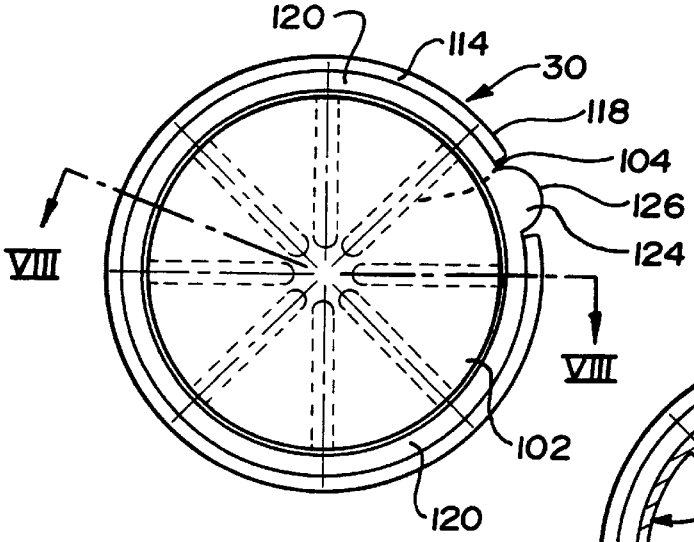
FIG. 9 illustrates a top plan view of the center post.
Figure 10:
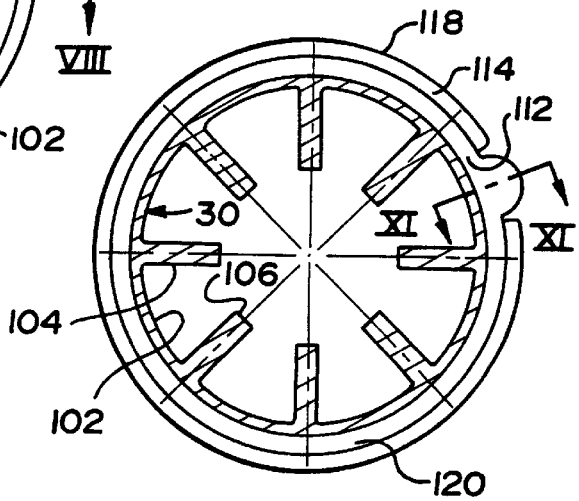
FIG. 10 illustrates a bottom plan view of that center post.
Figure 11:
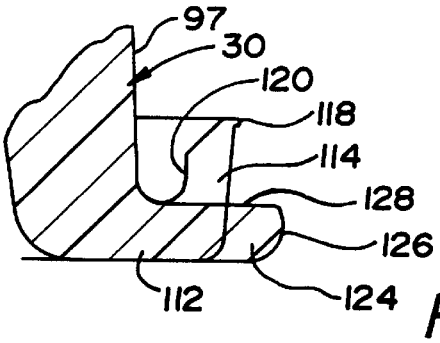
FIG. 11 shows a cross-sectional view of the center post's bottom taken along cross-sectional line XI—XI in FIG. 10.

FIGS. 9–11 illustrate locking protrusion 124 which extends outwardly from a break in flange 114. The outer periphery 126 of locking protrusion 124 is designed so as to nest within the lower end of bulbous groove housing 54 formed in extension 48. In this way, block 30 is prevented from rotation with respect to base 26 in a fashion similar to the tab 92/tab cavity 62 arrangement described above for bushing 28.

Locking protrusion 124, as shown in FIG. 11, also includes upper support surface 128. This upper support surface 128 supports the bulbous section of stem 24 which is described immediately below such that the lower edge of the stem 24 is supported along its entire length by an equal height support surface.

FIGS. 12 and 13 illustrate one embodiment of the stem 24 with FIG. 12 providing a bottom planar view of stem 24 and FIG. 13 providing a cutaway, cross-sectional view taken along cross-section line XIII—XIII in FIG. 12 with the upper portion of stem 24 cut away. As shown in FIGS. 12 and 13, stem 24 is a cylindrical member except for bulbous extension 130. Bulbous extension 130 features outwardly sloped upper section 132 and vertical bottom section 134. Thus, the outermost surface of bottom section 134 is spaced radially outwardly from the outermost section 136 of stem section 138 which lies above sloped upper section 132 of bulbous extension 130. As shown in FIG. 1, bulbous extension 130 of stem 24 is designed to have at least the lower 10% of vertical section 134 in a nested engagement with bulbous groove housing 54 (FIG. 3) of extension 48. Preferably, at least the lower half portion of vertical section 134 is at least partially received within bulbous groove housing 54 so as to provide assurance of non-rotation of stem 24 with respect to base assembly 22. FIG. 1 also illustrates bulbous extension 130 being oriented such that its center line corresponds with the center line of opening 90 formed between bushing ends 88 and 86 which opening provides the clearance for the initial assertion of the bulbous section 130 into engagement with bulbous groove housing 54. Following insertion section 138 of stem 24, bushing ring 28, and block 30 have concentric central axis.

The arrangement described above securely engages stem 24 within base assembly 22. The secure engagement is sufficient to avoid separation along the central axis of the stem 24 (especially when the center block 30 is deformed at the time of stem insertion or at least placed in a high friction contact.) The engagement also prevents an unacceptable degree of incline of stem 24 within assembly 22 and assures against rotation of stem 24 with respect to base 26. Moreover, the above-described arrangement allows for easy insertion as well as easy removal at the time desired, while avoiding undesirable axial removal prior to intentional removal due to the frictional engagement of the inclined protrusion of the bushing ring and also preferably frictional contact due to the clearance gap 58" being non-existent for at least the lower 10% of block 30 and preferably the lower 25–50% of block 30.

Reference is now made to FIGS. 14–21 which illustrate a second preferred embodiment of the present invention. As many of the features discussed above for the first embodiment have the same or similar features in the second embodiment, the discussion below will focus on the differences between the two embodiments. With respect to the base assembly and stem combination 200 shown in FIG. 14, the combination, like the earlier embodiment, includes base assembly 222 in combination with stem 224. Base assembly 222 is comprised of base 226, bushing ring 228 and center block 230. Base 226 features disk section 232 having a plurality of counter sunk bolt holes 234, a peripheral outer edge 236, and a smooth, convex upper surface 238 and corresponding bottom surface 242. The upper surface 238 has an essentially horizontal interior section 240 which is continuous with respect to the upper surface of bushing ring 228 received by disk 232. As with the earlier embodiment, spoke like ribs 244 extend off from bottom surface 242 and some of the radial spokes have an outer peripheral end wherein a boss-like section 246 is formed. Extension 248 is integral with the disk section 232 and ribs 244 and extends outwardly away from those components. In addition, the stem 224 is positioned between bushing 228 and center block 230.

Figure 14:
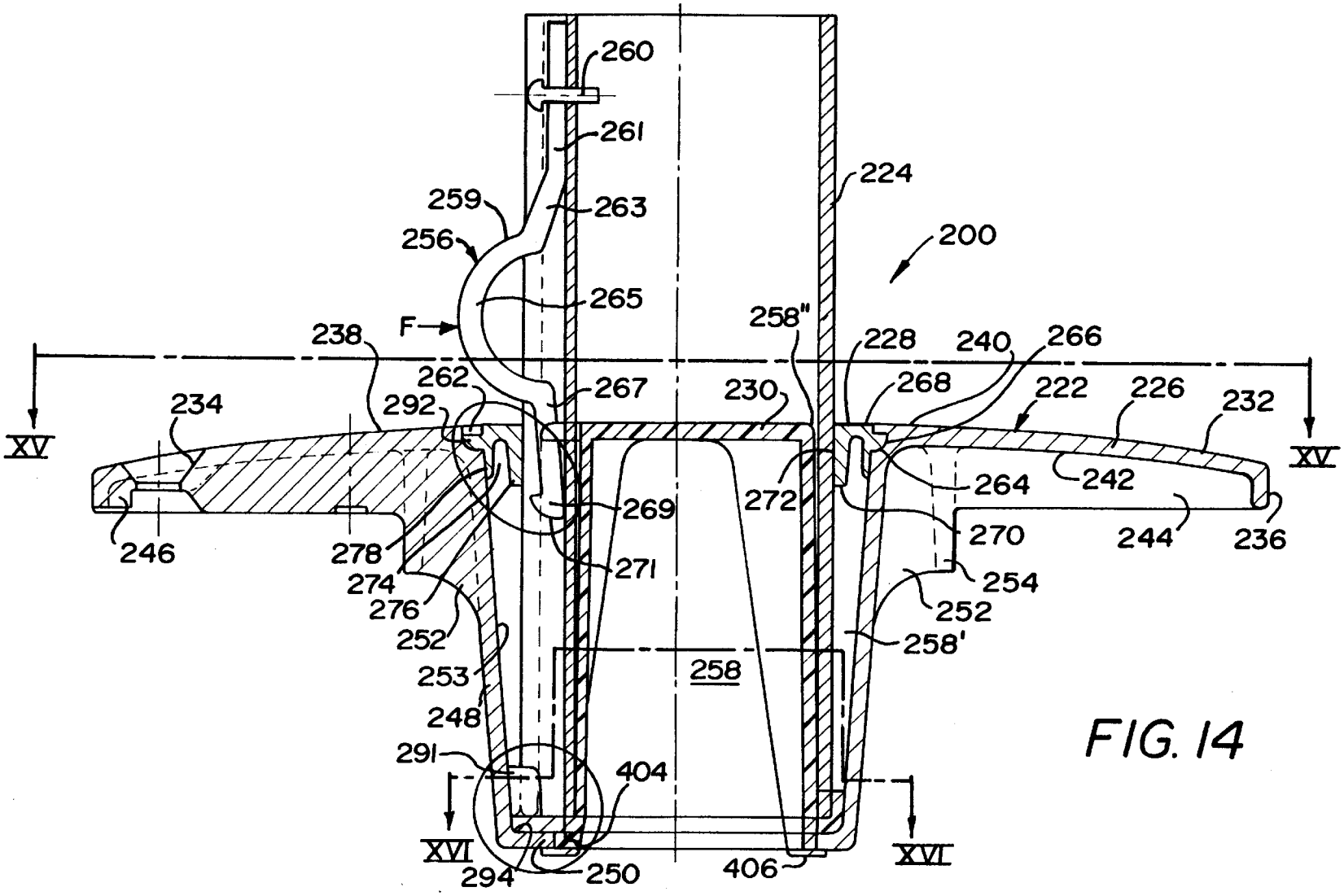
FIG. 14 illustrates, in cross-section, a second embodiment of the present invention's base assembly and stem combination.

FIG. 14 illustrates a modified base 226. Base 226 features strengthening webs 252 which are preferably of the same concentric thickness and aligned with ribs 244, but have a vertical length which is greater than that for the ribs 244. For example, the ribs 244 (and similarly the ribs 44 in the first embodiment) preferably extend off from the bottom surface of the disk a maximum vertical length of about 10–20% of the maximum vertical height of extension 248. While the webs 252 extend for preferably 20–40%, on average, of the total vertical height of the extension and more preferably have a convex curvature extending from 30% of that height at an outward end to 40% of that height at an inward end. In addition, circular ridge 254 is integral with the outer end of webs 252 and the inner end of ribs 244 and extends in circular fashion from the bottom surface 242 of disc section 232. The combination of ribs 244, ring ridge 254 and webs 252 provide significantly increased strength for helping to handle the large forces which develop in certain uses of the present invention such as a base and stem combination for a pleasure boat seat.

The second embodiment, as shown in FIG. 14, also comprises spring lock assembly 256 comprised of spring lock 259 and fastener 260 which is a screw or the like received in a threaded aperture formed in stem 224. This spring lock provides added security against axial separation of the stem from the base.

Stem 224, bearing 228, center block 230 and the lower end of extension 248 of base 226 are modified over the corresponding components of the first embodiment as described below.

Figure 15:
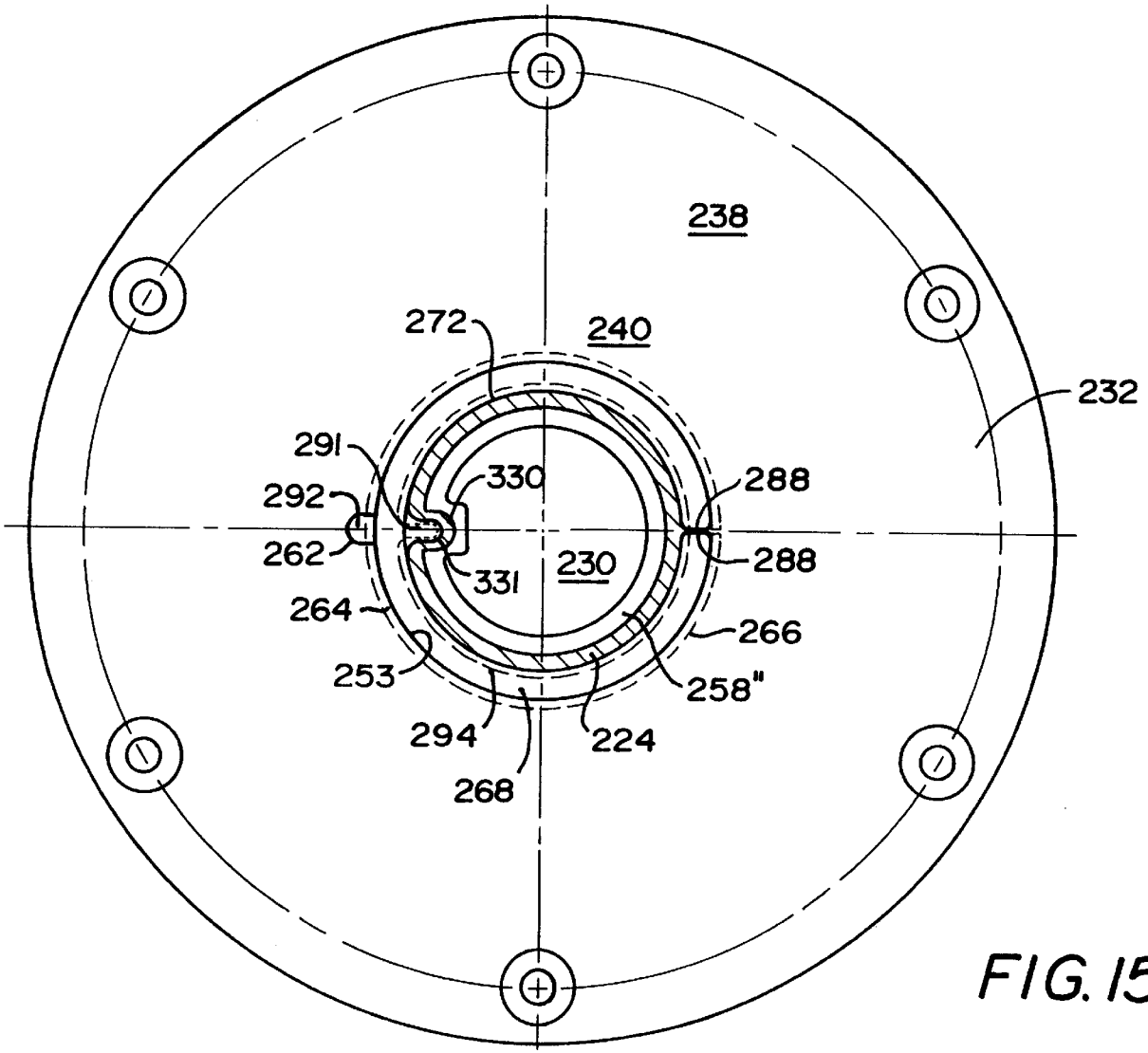
FIG. 15 illustrates a cross-sectional view taken along cross-section line XV—XV in FIG. 14 with the spring biased locking tab omitted for clarity.
Figure 16:
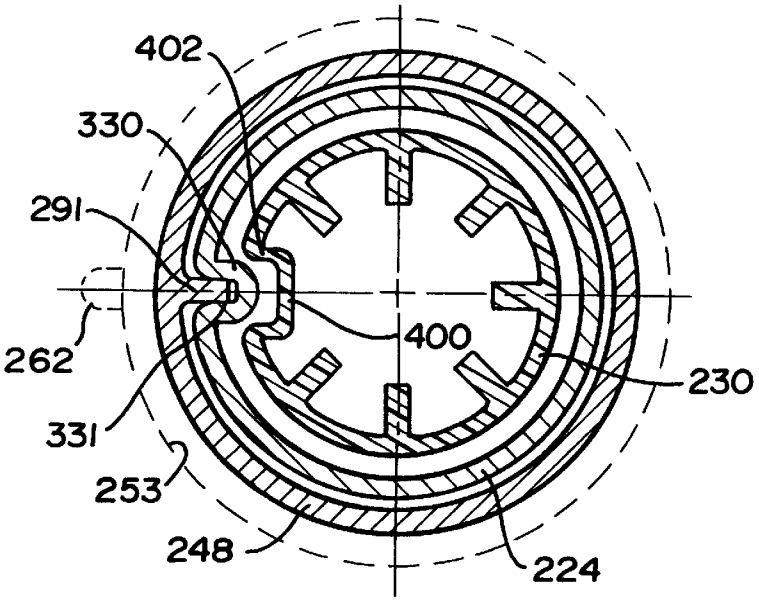
FIG. 16 represents a cross-sectional view taken along cross-section line XVI—XVI in FIG. 14.
Figure 19:
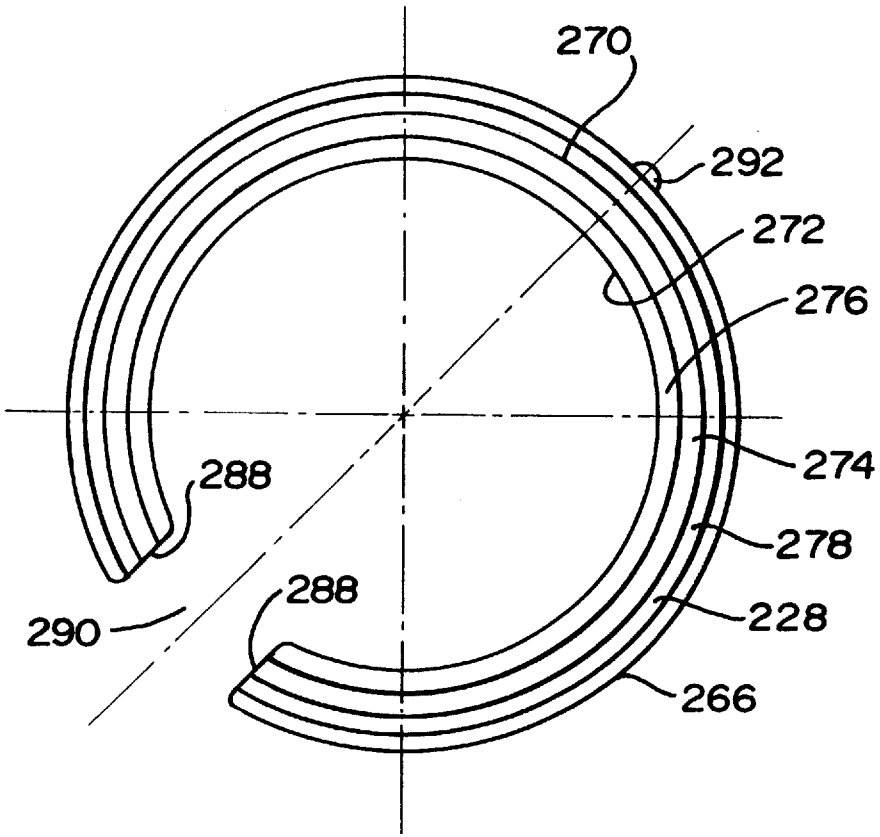
FIG. 19 shows a bottom plan view of the bushing shown in FIG. 14 in an expanded state prior to connection with the base.

FIGS. 14–16 illustrate the modified stem 224, modified bushing ring 228 and modified center block 230. With reference first to FIGS. 14, 15 and 19, the modified bushing ring 228 will be described. As with the earlier embodiment, in section 240 of upper surface 238 of disk 232 there is provided tab cavity 262 which receives tab 292 which preferably extends radially outward off from circular flange 266 of bushing ring 228. Circular flange 266 is received in ringed recess 264 formed in disk 232, as seen from the bottom view of bushing 228 in FIG. 19, bushing ring 228 features a planar upper surface 268 (FIG. 14) as well as lower end 270. Bushing ring 228 further features internal protrusion 276 and external protrusion 278 separated by circular slot 274. Internal protrusion 276 includes contact surface 272, which, because of its incline, presents a spring like centering force on stem 224 as described in the first embodiment.

As illustrated in FIG. 19, bushing 228 is different than the earlier described bushing 28 in that its free ends 288 are planar. The FIG. 19 embodiment shows bearing 228 prior to insertion within reception groove 264 formed in base 226 whereby an opening 290 exists. However, upon insertion of ringed flange 266 into groove 264, free ends 288 are placed in an abutting relationship as shown in FIG. 15. Unlike the earlier described embodiment, there is not provided a concave cavity in each end as this second embodiment features a stem with an inwardly extending bulbous extension 330 as opposed to the outwardly extending bulbous extension 130 in the first embodiment. Accordingly, during initial insertion, bushing ring 228 does not require a clearance gap or recess for receipt of the lower end of stem 224. FIG. 15 also illustrates clearance gap 258" formed between center block 230 and the inner surface of stem 224. Also, the inner surface 253 of extension wall 248 (as well as disk 232) coincides with the external periphery of the planar upper end 268 of bearing 228. Dash 294 in FIG. 15 also illustrates the most internal section of extension wall 248 off from which flanged support member 250 extends.

Housing groove 54 and bulbous extension 130 in the first embodiment provided the rotation lock between stem 24 and base 26. In this second embodiment, however, base assembly 226 is free of bulbous extension 54. Instead, in order to achieve the relative rotation locking between stem 224 and base 226, rotation lock member 291 extends inwardly off from the bottom end of extension 248. This relationship is shown in expanded fashion in FIG. 20 which illustrates an expanded view of the circled portion at the bottom of FIG. 14. FIG. 16 also provides a view of this relationship as FIG. 16 represents a view taken along cross-section line XVI—XVI at the bottom of FIG. 14. As shown in these figures, rotation locking member 291 has a thickness which is frictionally received by the longitudinal groove 331 (FIG. 17) defined by bulbous extension 330 formed in stem 224. Bulbous extension 330 can either extend for the full length of stem 224 or for only a lower end section of stem 224 following a smooth transition from the outer surface of stem 224 to the interior depth of groove 331.

During insertion of stem 224, groove 331 in stem 224 is aligned with locking projection 291 and the stem slid down into a locking engagement therewith. Tab cavity 262 formed in the upper surface of disk 232 helps in aligning groove 330 with locking projection 291 in the initial insertion. Also, although one tab/tab cavity combination is shown in FIGS. 1 and 14, additional tab/tab cavity combinations can be provided for even further assurance of non-rotation of bushing ring 228 (or 28). Furthermore, additional bulbous extension/rotation members can be further added if additional rotation prevention strength is desired, although one combination is sufficient for most intended cases.

FIG. 16 illustrates this alignment capability of tab cavity 262. Also, FIG. 16 schematically illustrates the orientation of tab cavity 262 and the upper end of interior surface 253 with respect to the cross-section of cross-section line XVI—XVI which cross-section is shown in solid lines in FIG. 16.

As shown in FIG. 14, spring lock assembly 256 is nested within groove 331 and is fastened in position within that groove by the aforementioned fastener 260. Spring lock 259 includes first section 261, inclined second section 263, finger contact third section 265, insertion fourth section 267 and locking hook 269. FIG. 14 illustrates spring lock 259 having been forced inwardly within groove 331. This would be the position of spring lock 259 either during insertion or during removal of stem 224 from base 226. During insertion, cam surface 271 of hook 269 is positioned so as to catch the corner of bushing ring 228 such that it rides inwardly and slides along the interior surface 272 of bushing ring 228. This relationship is more clearly illustrated in FIG. 21 which shows an expanded view of the area referenced by the ellipse in FIG. 14. Once hook 269 of spring lock 259 extends below the lower end of bearing 228, the bias of inclined second section 263 of spring lock 256 forces hook 269 radially outward so as to axially lock stem 224 in position with respect to bushing 228 which is, in turn, secured to base 226. This relationship avoids any accidental withdrawal of stem 224. When it is desired to remove stem 224 from base 226 an operator merely needs to press section 265 with his finger such that hook 269 moves internally of internal surface 272 of bushing ring 228 whereby axial withdrawal is possible.

With reference now to FIGS. 14, 16, 18 and 20, a description of the center post or block 230 is provided. As shown in these Figures, center block 230 is similar in design to the above described center block 30 for the first embodiment, except that it features inward bulbous projection 400 (FIG. 16) defining interior groove 402 which is dimensioned so as to ensure clearance with respect to bulbous extension 330 of stem 224. Groove 402 also helps in the initial alignment of bulbous section 330 when the stem is initially inserted into base 226 (thus providing for alternate positioning of tab cavity 262 if desired).

Figure 18:
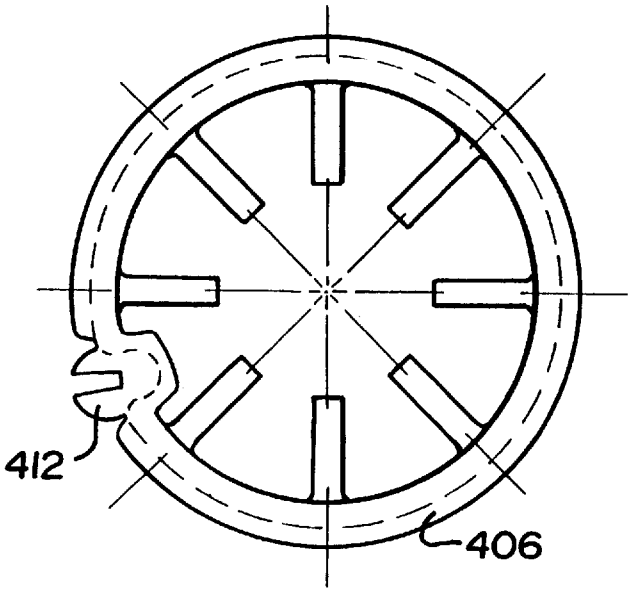
FIG. 18 shows a bottom plan view of the hat shaped center post shown in FIG. 14.
Figure 20:
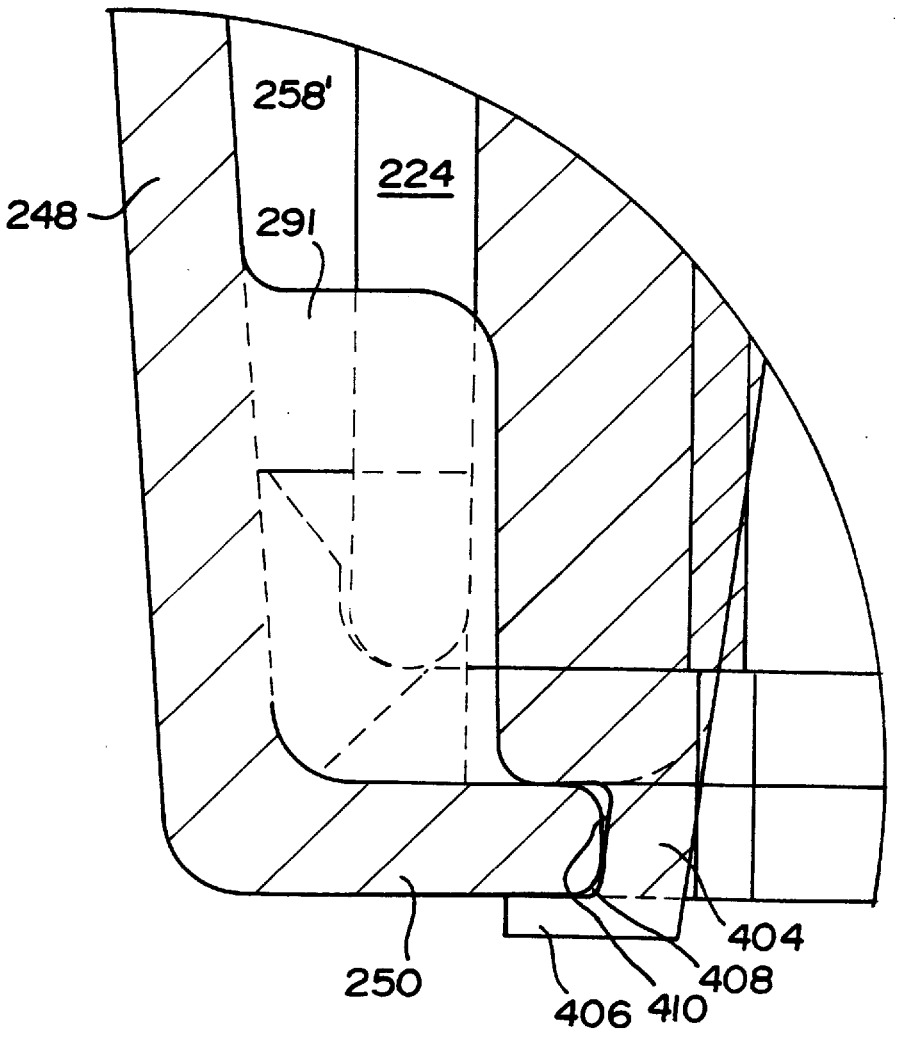
FIG. 20 illustrates an expanded view of the encircled area shown in FIG. 14.
Figure 21:
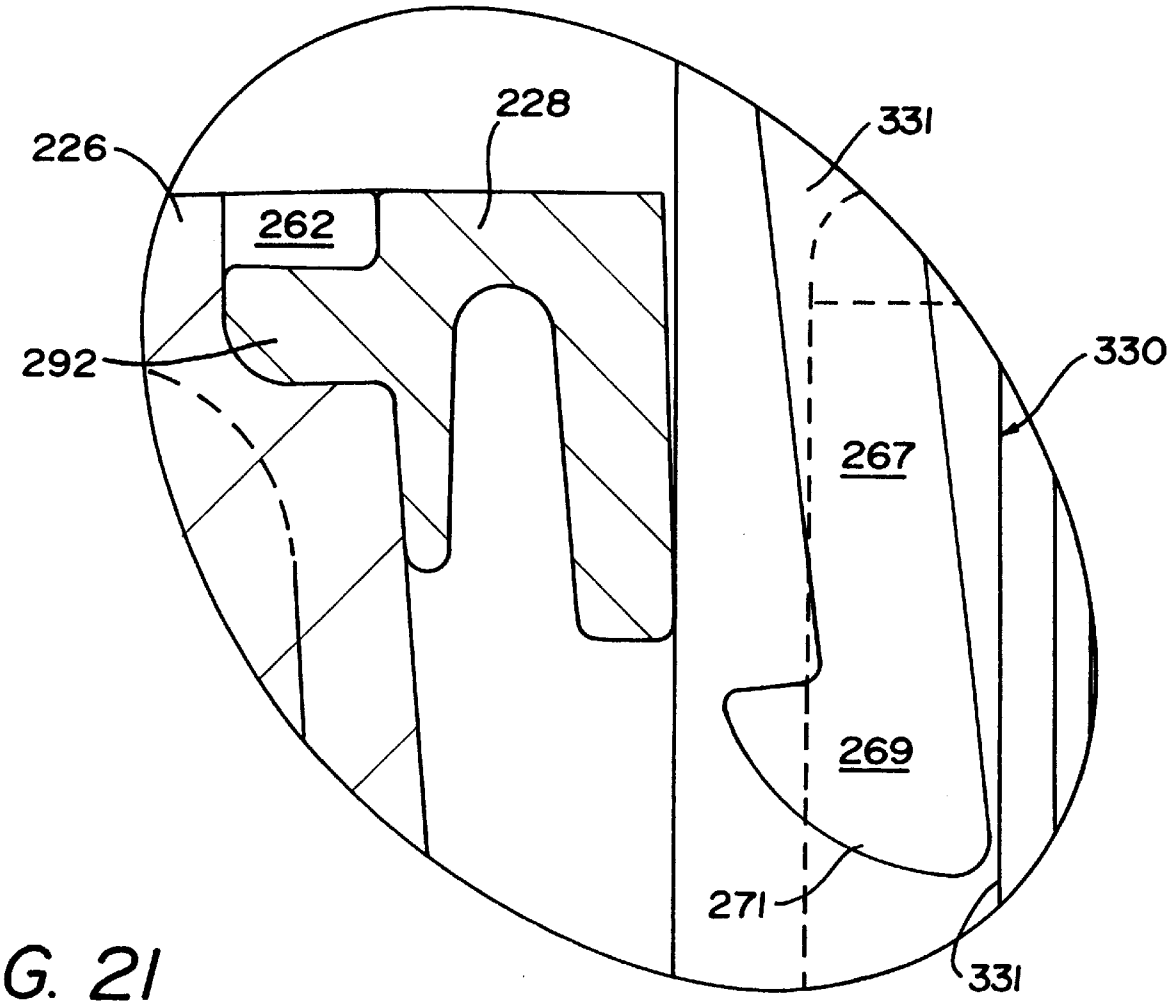
FIG. 21 shows an expanded view corresponding with the ellipse shown in FIG. 14.

An additional modification in center block 230 over that of the first embodiment lies in the means for securing the center block within the cavity 258 of extension 248. This alternate securing means features vertical extension section 404 (FIG. 14 and 20) as well as either a continuous (or interrupted) circular lip flange 406. Extension member 404 and lip flange 406 combine together to define recess 408 having an interior wall 410. Within this recess is received the free end of flange 250 as shown in FIG. 20. Also, while the inward extension of bulbous section 330 into cavity 402 would prevent an undue amount of relative rotation between center block 230 and the remainder of base assembly and stem combination 200, additional rotation preventing means can be provided as illustrated in FIG. 18 by slot member 412. Slot member 412 extends below the lower end of stem 224 and thus is free to engage the bottom of rotation locking member 291 extending off from extension wall 248.

Figure 17:
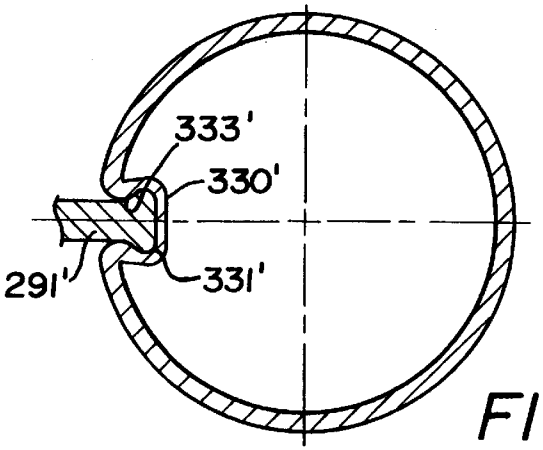
FIG. 17 illustrates a modified embodiment of the recess in the stem and the rotation preventing protrusion of the base.
Figure 17A:
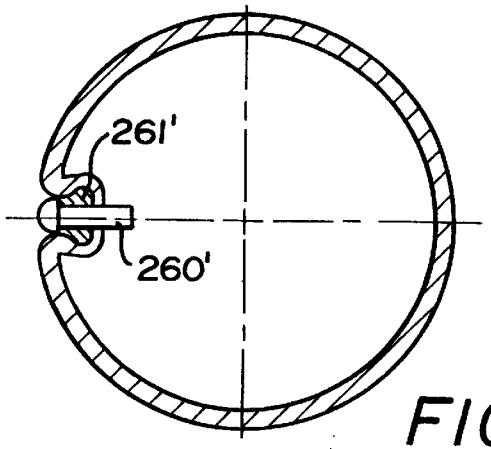
FIG. 17A illustrates a similarly designed stem as that in FIG. 17 in cross-section at the level of the fastener shown in FIG. 14.

FIG. 17 illustrates an alternate configuration for groove extension 330, and this alternate configuration is referenced by reference no. 330'. Groove extension 330' features an elliptical groove section 331' which opens out at a smaller width, inlet groove section 333'. To correspond with the modified groove configuration, modified rotation locking member 291' is provided as illustrated in FIG. 17. The bone shaped end of locking member 291 is designed for sliding insertion within groove sections 331' and 333' whereby rotational locking is achieved and also a degree of radial locking which can be useful in centering the device and also preventing the stem from tilting too far off from a transverse orientation with the underlying surface. FIG. 17A shows fastener 260' and modified spring lock assembly 261' which has been altered in cross-section to correspond with the change in the groove shape.

Figure 22:
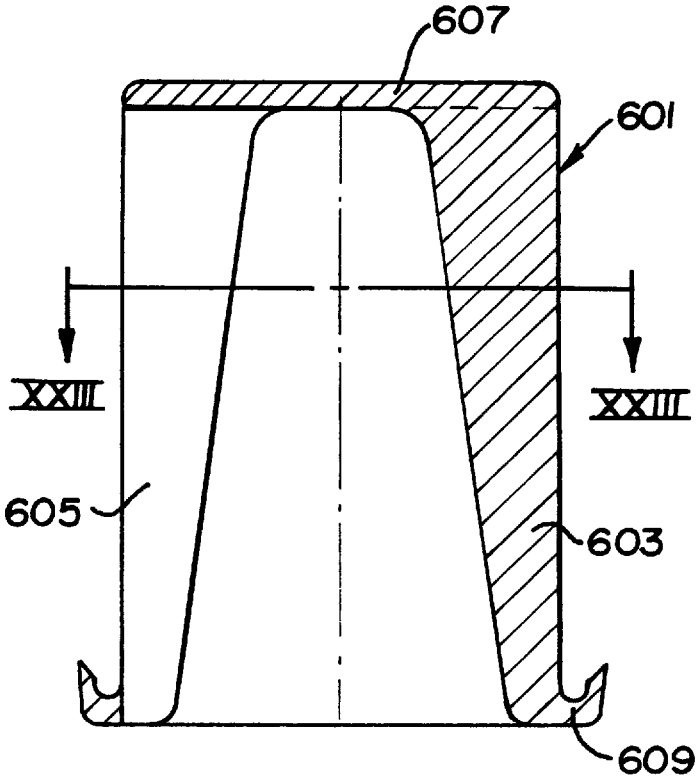
FIG. 22 shows a cross-sectional view of an alternate embodiment of the center post.
Figure 23:
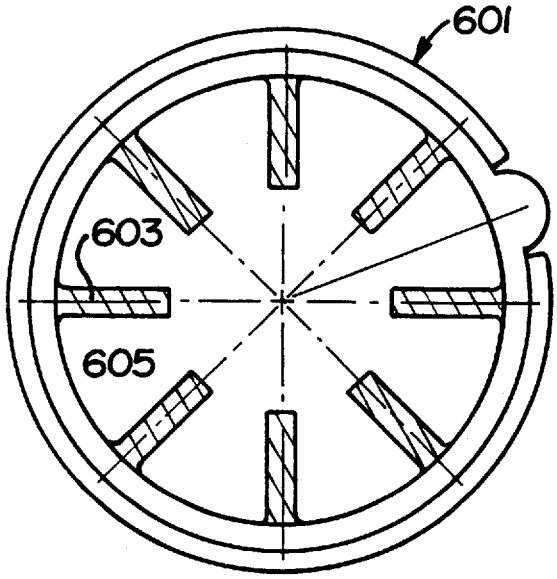
FIG. 23 shows a cross-sectional view of an alternate embodiment of the center post taken at level XXII—XXII in FIG. 22.

FIGS. 22 and 23 illustrate an alternate embodiment 601 of the center post which is shown in FIG. 8. Center post 601 is similar to center post 30 except that rather than a continuous outer cylindrical side wall, the side of center post 601 is comprised or ribs 603 separated by windows or clearings 605. Thus, center post 601 is comprised of continuous top surface 607, a plurality of ribs 603 with ring shaped circular flange 609 joining the bottom of ribs 603, and clearings 605 formed between the ribs and the upper top surface 607 and flanged rim 609.

Center post 601 is particularly suited for avoiding the build up of debris which happens to fall through the minimized gap discussed above (e.g., 58" in FIG. 7). For example, a common problem associated with prior art boat seat mounts is the build up of sand which can fall between the stem and reception cavity of a base and make it difficult to remove the stem. Windows 605 enable sand and the like, which happens to fall through the minimized gap, to fall out through the windows so as to avoid the possibility of lock up due to the gritty sand particles.

Although the present invention has been described with reference to preferred embodiments, the invention is not limited to the details thereof. Various substitutions and modifications will occur to those of ordinary skill in the art, and all such substitutions and modifications are intended to fall within the spirit and scope of the invention as defined in the appended claims.

What is claimed is:

1. A base assembly for supporting a stem, comprising:

a base having a reception cavity formed therein;

a bushing ring supported by said base and extending into said reception cavity, said bushing ring having an interior surface adapted for contact with the stem once inserted;

a center post positioned within said reception cavity and supported by said base, said center post having a top surface and a side wall, said side wall being spaced from an interior surface of said base defining said reception cavity so as to define a stem reception gap between said side wall and interior surface and said side wall being non-parallel to said internal surface; and wherein said bushing ring is received at a first end of said reception cavity and said center post includes a flanged rim which is supported by a bottom section of said base at a second end of said reception cavity, whereby said flanged rim is dimensioned so as to contact a free end of the stem when inserted into said reception cavity while said bushing ring is dimensioned so as to contact and center the inserted stem at a location spaced from the free end of the stem.

2. A base assembly as recited in claim 1 wherein said bushing ring includes an elastically deformable interior protrusion which is at an incline toward a central axis of said center post, said protrusion deflecting radially outwardly upon insertion of the stem into said reception cavity.

3. A base assembly as recited in claim 1 wherein said base includes a groove housing which is dimensioned to receive a correspondingly shaped projection in the stem to be inserted.

4. A base assembly as recited in claim 1 wherein said base includes an upper, convex in cross-section surface extending radially out from around said reception cavity, which cavity is centered in said base.

5. A base assembly as recited in claim 1 wherein said base includes an upper disc section and an extension extending out away from an undersurface of said disc section to a free end, and said reception cavity being defined by an interior wall surface of said extension and disc section.

6. A base assembly as recited in claim 1 further comprising an attachment unit to which said base is secured.

7. A base assembly for supporting a stem, comprising:

a base having a reception cavity formed by an interior surface of said base;

a bushing ring supported by said base and extending into said reception cavity, said bushing ring having an interior surface adapted for contact with the stem once inserted;

a center post positioned within said reception cavity and supported by said base, said center post having a top surface and a side wall, said side wall being spaced from the interior surface of said base so as to define a stem reception gap between said side wall and the interior surface of said base, wherein said bushing ring is received at a first end of said reception cavity and said center post includes a flanged rim which is supported by a bottom section of said base at a second end of said reception cavity, whereby said flanged rim is dimensioned so as to contact a free end of the stem when inserted into said reception cavity while said bushing ring is dimensioned so as to contact and center the inserted stem at a location spaced from the free end of the stem, wherein said bushing ring includes an interior protrusion which is at an incline toward a central axis of said center post, and said protrusion being elastically deformable such that said protrusion deflects radially outwardly upon insertion of the stem into said reception cavity, and wherein one of said bushing ring and said base has a ringed flange and an opposite one of said bushing ring and said base has a ringed recess corresponding to said ringed flange, said bushing ring being secured to said base by said ringed flange being received in said ringed recess, and said bushing ring has a second protrusion positioned outwardly of said inclined protrusion so as to contact said interior surface of said base which defines said reception cavity, and wherein said bushing ring has a ringed slot positioned between said two protrusions.

8. A base assembly for supporting a stem, comprising:

a base having a reception cavity formed by an interior surface of said base;

a bushing ring supported by said base and extending into said reception cavity, said bushing ring having an interior surface adapted for contact with the stem once inserted;

a center post positioned within said reception cavity and supported by said base, said center post having a top surface and a side wall, said side wall being spaced from the interior surface of said base so as to define a stem reception gap between said side wall and the interior surface of said base, wherein said bushing ring is received at a first end of said reception cavity and said center post includes a flanged rim which is supported by a bottom section of said base at a second end of said reception cavity, whereby said flanged rim is dimensioned so as to contact a free end of the stem when inserted into said reception cavity while said bushing ring is dimensioned so as to contact and center the inserted stem at a location spaced from the free end of the stem, wherein said bushing ring includes an interior protrusion which is at an incline toward a central axis of said center post, and said protrusion being elastically deformable such that said protrusion deflects radially outwardly upon insertion of the stem into said reception cavity, and wherein said center post and bushing ring are formed of a plastic material and said base is formed of a metal material.

9. A base assembly for supporting a stem, comprising:

a base having a reception cavity formed by an interior surface of said base;

a bushing ring supported by said base and extending into said reception cavity, said bushing ring having an interior surface adapted for contact with the stem once inserted;

a center post positioned within said reception cavity and supported by said base, said center post having a top surface and a side wall, said side wall being spaced from the interior surface of said base so as to define a stem reception gap between said side wall and the interior surface of said base, wherein one of said center post and said base includes a recessed section and an opposite one of said center post and said base includes a protruding section, said protruding section being received within said recessed section so as to axially lock said center post with respect to said base.

10. A base assembly for supporting a stem, comprising:

a base having a reception cavity formed by an interior surface of said base;

a bushing ring supported by said base and extending into said reception cavity, said bushing ring having an interior surface adapted for contact with the stem once inserted;

a center post positioned within said reception cavity and supported by said base, said center post having a top surface and a side wall, said side wall being spaced from the interior surface of said base so as to define a stem reception gap between said side wall and the interior surface of said base, wherein said bushing ring is received at a top end of said reception cavity which is opposite a second end of said reception cavity, and said base includes a ringed recess at a location between said top and second end of said reception cavity, and said center post includes a flanged rim positioned at the second end of said cavity, and the flanged rim of said center post includes an upwardly and outwardly extending flange section which is elastic and has a tip dimensioned for reception in said ringed recess in said base.

11. A base assembly for supporting a stem, comprising:

a base having a reception cavity formed therein;

a bushing ring supported by said base and extending into said reception cavity, said bushing ring having an interior surface adapted for contact with the stem once inserted;

a center post positioned within said reception cavity and supported by said base, said center post having a top surface and a side wall, said side wall being spaced from an interior surface of said base defining said reception cavity so as to define a stem reception gap between said side wall and interior surface and said side wall being non-parallel to said internal surface; and wherein said base and bushing ring have cooperating means for axially locking said bushing with respect to said base and rotationally locking said bushing with respect to said base, and said base assembly further comprising cooperating means for axially locking said center post with respect to said base and for rotationally locking said center post with respect to said base, and said base including means for preventing an inserted stem from rotating with respect to said base.

12. A base assembly for supporting a stem, comprising:

a base having a reception cavity formed therein;

a bushing ring supported by said base and extending into said reception cavity, said bushing ring having an interior surface adapted for contact with the stem once inserted;

a center post positioned within said reception cavity and supported by said base, said center post having a top surface and a side wall, said side wall being spaced from an interior surface of said base defining said reception cavity so as to define a stem reception gap between said side wall and interior surface and said side wall being non-parallel to said internal surface; and wherein said base includes a rotation locking member which projects inwardly off from a wall surface of said base defining said reception cavity, and said rotation locking member being dimensioned for reception by a correspondingly shaped groove section formed in the stem to be inserted, and said center post including a corresponding shaped groove.

13. A base assembly for supporting a stem, comprising:

a base having a reception cavity formed by an interior surface of said base;

a bushing ring supported by said base and extending into said reception cavity, said bushing ring having an interior surface adapted for contact with the stem once inserted;

a center post positioned within said reception cavity and supported by said base, said center post having a top surface and a side wall, said side wall being spaced from the interior surface of said base so as to define a stem reception gap between said side wall and the interior surface of said base, wherein said base has an upper horizontal section surrounding the reception cavity, said bushing also including a horizontal section, and the top of said center post being horizontal such that each of said horizontal sections and said top of said center post lie on a common plane.

14. A base assembly for supporting a stem, comprising:

a base having a reception cavity formed by an interior surface of said base;

a bushing ring supported by said base and extending into said reception cavity, said bushing ring having an interior surface adapted for contact with the stem once inserted;

a center post positioned within said reception cavity and supported by said base, said center post having a top surface and a side wall, said side wall being spaced from the interior surface of said base so as to define a stem reception gap between said side wall and the interior surface of said base, wherein said base includes an upper disc section and an extension extending out away from an undersurface of said disc section to a free end, and said reception cavity being defined by an interior wall surface of said extension and disc section, and wherein said base further includes a plurality of ribs extending radially along said undersurface, and said ribs providing support to said extension, and said bushing ring including a flange which is dimensioned for receipt within a groove formed in said interior wall surface of said base so as to axial lock the bushing ring to said flange at an upper end of said reception cavity, and said center post including means for axial locking the center post to the base at a lower end of said reception cavity.

15. A base assembly for supporting a stem, comprising:

a base having a reception cavity formed by an interior surface of said base;

a bushing ring supported by said base and extending into said reception cavity, said bushing ring having an interior surface adapted for contact with the stem once inserted;

a center post positioned within said reception cavity and supported by said base, said center post having a top surface and a side wall, said side wall being spaced from the interior surface of said base so as to define a stem reception gap between said side wall and the interior surface of said base, wherein said base includes an upper disc section and an extension extending out away from an undersurface of said disc section to a free end, and said reception cavity being defined by an interior wall surface of said extension and disc section, and wherein said base further includes a plurality of strengthening webs positioned between said ribs and said extension, and said base still further comprising a strengthening ring extending off from said undersurface and being integral with said ribs and webs at a juncture point therebetween.

16. A base assembly for supporting a stem, comprising:

a base having a reception cavity formed by an interior surface of said base;

a bushing ring supported by said base and extending into said reception cavity, said bushing ring having an interior surface adapted for contact with the stem once inserted;

a center post positioned within said reception cavity and supported by said base, said center post having a top surface and a side wall, said side wall being spaced from the interior surface of said base so as to define a stem reception gap between said side wall and the interior surface of said base, and wherein said base includes an upper disc section with an upper surface and an undersurface, said disc section having a plurality of mounting through holes extending between the upper and undersurface of said disc section, and said base including an extension section which extends out away from the undersurface of said disc section to a bottom end, and said base further including a flanged stop extending inwardly off from the bottom end of said extension and being in contact with a bottom end of said center post, and said center post having a hollow interior covered by a top section of said post and a plurality of rib supports extending within said hollow interior.

17. A base assembly for supporting a stem, comprising:

a base having a reception cavity formed by an interior surface of said base;

a bushing ring supported by said base and extending into said reception cavity, said bushing ring having an interior surface adapted for contact with the stem once inserted;

a center post positioned within said reception cavity and supported by said base, said center post having a top surface and a side wall, said side wall being spaced from the interior surface of said base so as to define a stem reception gap between said side wall and the interior surface of said base, wherein said center post is a hat shaped component having a planar top surface a side wall surrounding an internal hollow and a lower rim section, and said base features an upper disc section and an extension which extends out from an undersurface of said disc section, said extension having an internal wall which defines said reception cavity, said base further including a bottom support positioned below and supporting the rim section of said center post, and said center post being formed of a plastic material and said lower rim section having an upwardly extending flange component which is dimensioned so as, together with the side wall, to define a reception slot which is adapted to frictionally detain a free end of a stem once inserted, and said bushing ring being positioned at an upper end of said reception cavity and having an inner end spaced further radially inward than a radial outer surface of said reception slot which outer surface is defined by an inner surface of the flange component of said center post.

18. A base assembly as recited in claim 17 wherein said center post includes a lip extension extending off from said rim section and said bottom support is an inwardly extending flange member extending off from a bottom end of said base extension and said lip extension defining a groove within which said inwardly extending flange of said bottom support is received so as to axially lock said center post to said base.

19. A base assembly for supporting a stem, comprising:

a base having a reception cavity formed by an interior surface of said base;

a bushing ring supported by said base and extending into said reception cavity, said bushing ring having an interior surface adapted for contact with the stem once inserted;

a center post positioned within said reception cavity and supported by said base, said center post having a top surface and a side wall, said side wall being spaced from the interior surface of said base so as to define a stem reception gap between said side wall and the interior surface of said base, and wherein said center post includes a flanged rim section with a stem edge reception groove formed therein and a radial outer edge of said reception groove being positioned radial outward from an internal most edge of said bushing ring when in an uncompressed state.

20. A base assembly for supporting a stem, comprising:

a base having a reception cavity formed therein;

a bushing ring supported by said base and extending into said reception cavity, said bushing ring having an interior surface adapted for contact with the stem once inserted;

a center post positioned within said reception cavity and supported by said base, said center post having a top surface and a side wall, said side wall being spaced from an interior surface of said base defining said reception cavity so as to define a stem reception gap between said side wall and interior surface and said side wall being non-parallel to said internal surface; and wherein said center post is comprised of a series of ribs extending from the side wall of said center post to the interior of said center post, said ribs being separated by at least one clearing.

21. A base assembly and stem combination comprising a base assembly and a stem, said base assembly comprising:

a base having a reception cavity formed by an interior surface of said base;

a bushing ring supported by said base and extending into said reception cavity, said bushing ring having an interior surface adapted for contact with the stem once inserted;

a center post positioned within said reception cavity and supported by said base, said center post having a top surface and a side wall, said side wall being spaced from the interior surface of said base so as to define a stem reception gap between said side wall and the interior surface of said base, said side wall being non-parallel to said interior surface; and said stem having an insert end which is dimensioned to receive said center post internally, said stem also including a groove section for cooperation with a rotation locking section of said base.

22. A base assembly and stem combination as recited in claim 21 wherein said groove section features an internally extending groove housing and said rotation locking section of said base includes an inwardly projecting ridge shaped for reception in said groove housing.

23. A base assembly and stem combination as recited in claim 21 further comprising a stem axial locking device.

24. A base assembly and stem combination comprising a base assembly and a stem, said base assembly comprising:

a base having a reception cavity formed by an interior portion of said base;

a bushing ring supported by said base and extending into said reception cavity, said bushing ring having an interior surface adapted for contact with the stem once inserted; and a center post positioned within said reception cavity and supported by said base, said center post having a top surface and a side wall, said side wall being spaced from the interior portion of said base defining said reception cavity so as to define a stem reception gap between said side wall and the interior surface portion of said base, said stem having an insert end which is dimensioned to receive said center post internally, said stem also including a groove section for cooperation with a rotation locking section of said base, wherein said groove section features an internally extending groove housing and said rotation locking section of said base includes an inwardly projecting ridge shaped for reception in said groove housing, and wherein said groove housing defines in cross section a groove having a larger width internal portion and a more outward portion which is of a smaller width than said internal portion such that said inwardly projecting ridge, which has a corresponding shaped cross-section, is radially locked within said groove.

25. A base assembly and stem combination comprising a base assembly comprising:

a base having a reception cavity formed by an interior surface of said base, a bushing ring supported by said base and extending into said reception cavity, said bushing ring having an interior surface adapted for contact with the stem once inserted, and a center post positioned within said reception cavity and supported by said base, said center post having a top surface and a side wall, said side wall being spaced from the interior surface of said base so as to define a stem reception gap between said side wall and the interior surface of said base; and a stem, said stem having an insert end which is dimensioned to receive said center post internally, said stem also including a groove section for cooperation with a rotation locking section of said base, wherein said groove section of said stem features an outwardly extending groove housing dimensioned for receipt within a complementary groove housing formed in a wall of said base defining said reception cavity.

26. A boat seat stem and base assembly comprising:

a stem having an upper end for supporting a boat chair seat and a lower end with an internal cavity;

a base assembly comprising;

a base with a reception cavity formed therein having an upper end and a bottom end, said base having means for mounting to an attachment unit as well as an interior surface defining said reception cavity, and said base having a support member provided at a lower end of said reception cavity, a center post having a top section, a side wall extending off from said top section and a lower end supported by said support member, and a spring lock assembly which has a spring lock with a hooked end and a securement member for securing said spring lock to said stem and said spring lock being dimensioned and arranged such that the hook contacts an edge of said base assembly when in a locking state.

27. A base assembly and stem combination as recited in claim 26 wherein said spring lock is received within a groove section defined in said stem.

28. A boat seat stem and base assembly as recited in claim 26 wherein said center post has a flanged rim at a low end of said side wall, said flanged rim defining a stem reception slot between said side wall and an upwardly extending flange portion of said flanged rim, which stem reception slot is dimensioned such that the lower end of said stem is frictionally detained therein, once inserted, and the lower end of said center post being supported by said support member of said base and said side wall being spaced from said interior surface of said base so as to define a stem reception gap, and said top section of said center post being dimensioned for reception in the internal cavity at the lower end of said stem and said stem and base assembly being dimensioned such that said stem is locked from rotation upon said stem being positioned in said stem reception slot.

29. An assembly as recited in claim 26 wherein said base further comprises:

a bushing ring which is positioned at the upper end of said reception cavity and is axially fixed to said base, said bushing ring having an interior surface adapted for contact with said stem inserted over said center post.

30. A method for forming a base assembly comprising:

forming a base so as to have an upper disc section, an extension extending off from an undersurface of said disc section and a reception cavity formed so as to open out at a top surface of said disc section and extend into said extension with said extension also being formed so as to have a stem rotation locking section;

installing a bushing member so as to have an upper surface coplanar with a section of the upper surface of said disc surrounding the reception cavity and such that said bushing member extends radially inwardly within said reception cavity, said installing including locking means for axial locking said bushing member with respect to said base;

installing a center post in said reception cavity such that it is supported on a support of said base and has a top surface coplanar with the upper surface of said disc and an outer wall spaced from an inner wall of said reception cavity, and said installing of said center post includes locking means for rotational and axial movement locking of said center post and said base.

* * * * *